United States Patent [19]

Leichhardt

[11] 4,111,248

[45] Sep. 5, 1978

[54] GOLF CLUB CARRIER

[76] Inventor: Harold A. Leichhardt, 178 Desert Lakes Dr., Palm Springs, Calif. 92262

[21] Appl. No.: 808,199

[22] Filed: Jun. 20, 1977

[51] Int. Cl.[2] ..... A63B 55/00

[52] U.S. Cl. ..... 150/1.5 R

[58] Field of Search ..... 150/1.5 R, 1.5 B, 1.5 C; 211/60 G, 70, 131, 163

[56] References Cited

U.S. PATENT DOCUMENTS

| | | | |
|---|---|---|---|
| 1,599,170 | 9/1926 | Fatjo | 150/1.5 R |
| 1,788,478 | 1/1931 | Beaty | 150/1.5 C |
| 2,806,711 | 9/1957 | Jacobs | 211/70 X |
| 2,926,713 | 3/1960 | Vaughan | 150/1.5 R |
| 2,972,420 | 2/1961 | Tucci | 211/163 X |
| 3,503,518 | 3/1970 | Black | 150/1.5 R X |
| 3,664,399 | 5/1972 | Neff | 150/1.5 R |
| 3,826,378 | 7/1974 | Novak | 211/70 X |
| 3,981,405 | 9/1976 | Slack | 211/70 |

*Primary Examiner*—Donald F. Norton
*Attorney, Agent, or Firm*—Donald D. Mon

[57] ABSTRACT

A golf club carrier which includes a support that carries a rotatable golf club holder. The golf club holder has an axis of rotation and a plurality of retention means laterally spaced from the axis which move circularly around the axis when the club holder is rotated in the support. The support is constructed and arranged to allow access to clubs held by the retention means.

12 Claims, 12 Drawing Figures

GOLF CLUB CARRIER

This invention relates to a golf club carrier.

It is becoming less frequent for a conventional golf club bag to be carried by the player himself. Instead golf club bags are most often transported by a motorized cart. It is customary to attach a conventional golf bag to the rear of the cart by resting its bottom on a shelf and hanging some portion of it from a hook. More recently, shelves have been provided on the cart on which the bag can be stood up vertically. Both of these arrangements have the disadvantage that the clubs become mixed, and rattle against one another so as to degrade and wear their finishes and wrappings.

It is an object of this invention to provide a golf club carrier which, while it still can be carried by an individual and still can be attached to a conventional pull cart, is most advantageously transported on a cart with a horizontal shelf on which it can stand up. The recited disadvantages of the prior art are overcome by means for mounting and making available the individual clubs in an orderly manner.

A golf club carrier according to this invention comprises a support which can be rested on a base such as the shelf of a golf cart, and a golf club holder having an axis of rotation. The club holder is axially elongated, and is mounted to the support for rotation around its central axis.

A plurality of retention means is provided on the holder. These means are laterally spaced from the axis, whereby they move circularly around the axis when the club holder is rotated in order to make the clubs selectively available. The support is so constructed and arranged as to give access to clubs held by the retention means.

According to a preferred but optional feature of the invention, the support includes a pair of bearing means which rotatably journal the club holder to the support.

According to still another preferred but optional feature of the invention, the retention means comprises axially-extending grooves in the club holder and a socket member to receive the handle end of the club.

The above and other features of this invention will be fully understood from the following detailed description and the accompanying drawings, in which.

Figure 1:
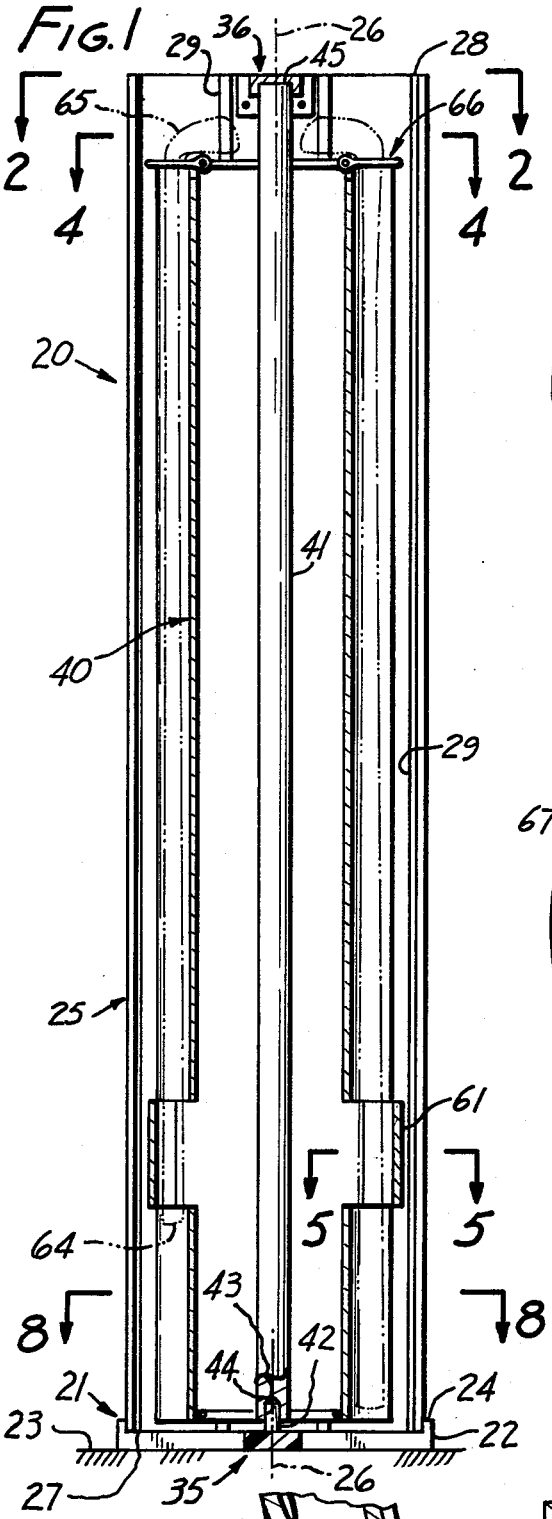
FIG. 1 is a side elevation partly in cutaway cross-section of the preferred embodiment of the invention.
Figure 4:
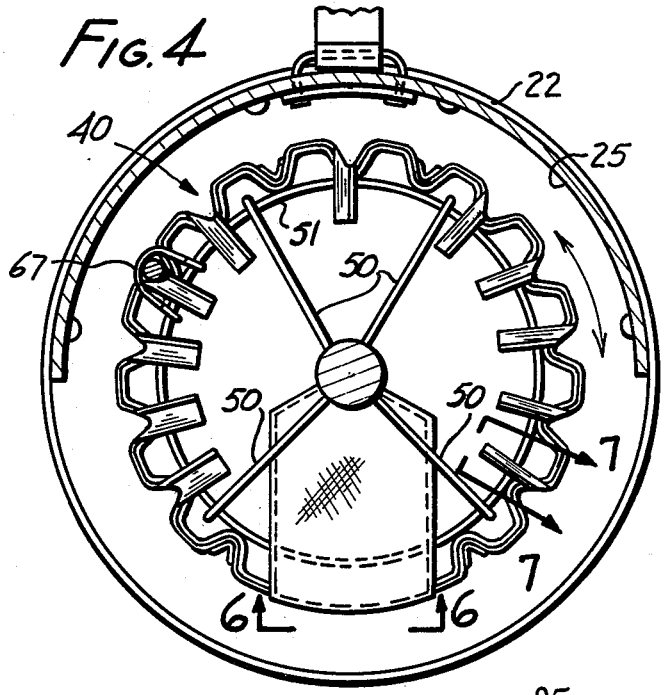
Figure 5:
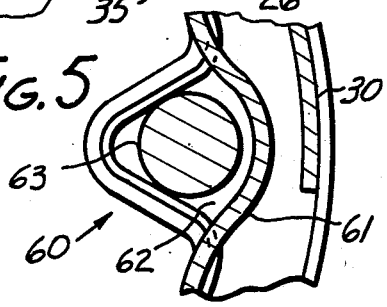
Figure 3:
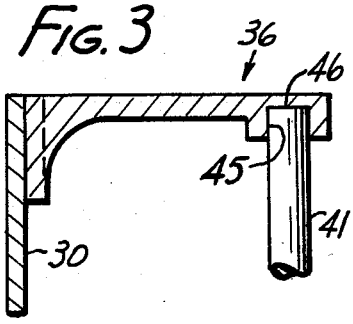
FIG. 3 is a fragmentary cross-section taken of a portion of FIG. 2.
Figure 6:
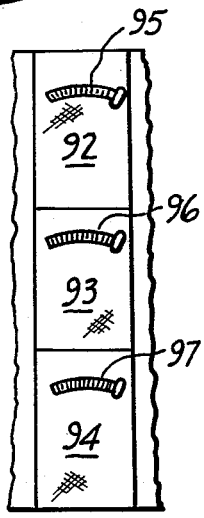
Figure 8:
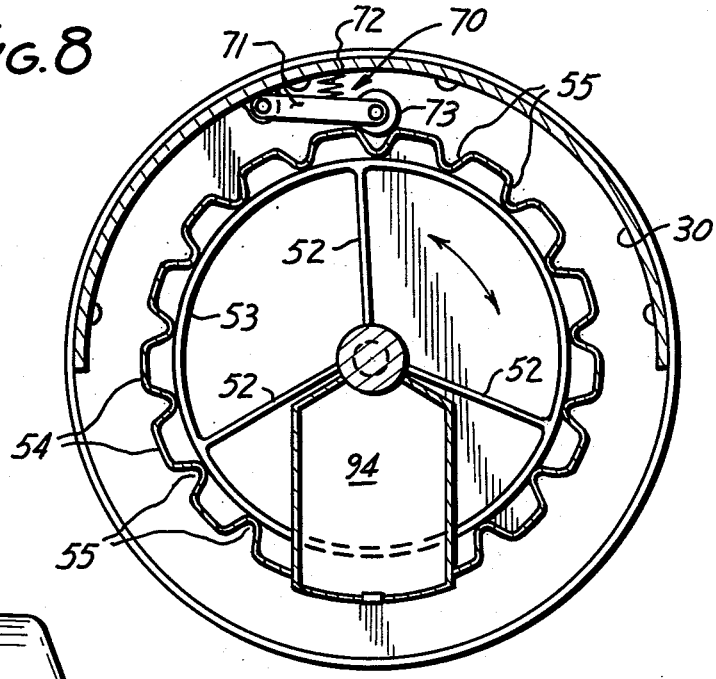
Figure 7:
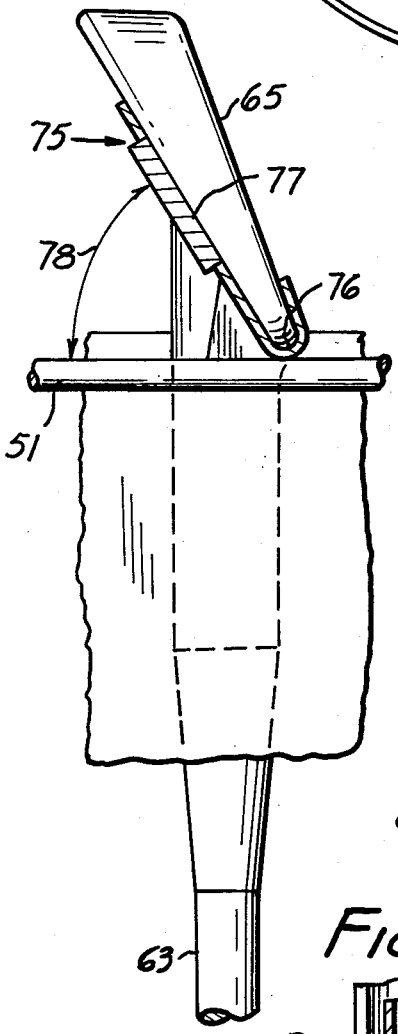
Figure 9:
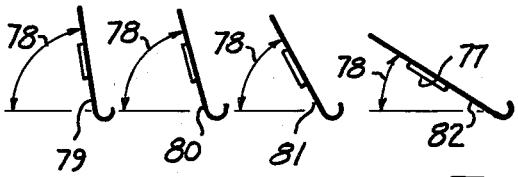
Figure 10:
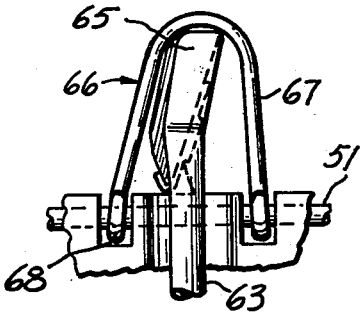
Figure 11:
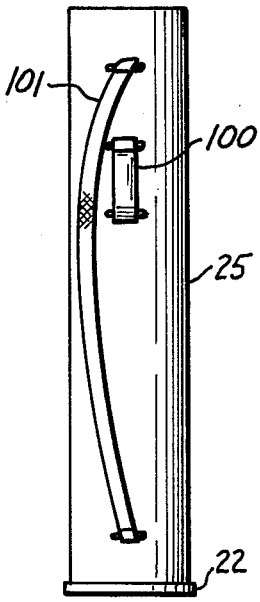

FIGS. 4 and 5 are cross-sections taken at lines 4—4 and 5—5 respectively in FIG. 1;

FIG. 6 is a fragmentary side elevation taken at line 6—6 in FIG, 4;

FIG. 7 is a fragmentary elevation showing one embodiment of retention means according to the invention;

FIG. 8 is a cross-section taken at line 8—8 in FIG. 1;

FIG. 9 shows a desirable relationship between clips of the type shown in FIG. 7;

FIG. 10 is a detailed showing of a portion of a retention means according to the invention;

FIG. 11 is a rear elevation of FIG. 1; and

Figure 12:
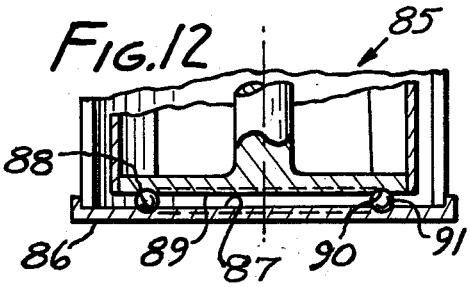

FIG. 12 shows an alternate embodiment of bearing means useful with this invention.

FIG. 1 shows the presently preferred embodiment of golf club carrier 20. It includes a support 21 which has a base 22 that is intended to rest upon a shelf 23 which is part of a motorized golf cart. The support can if desired be a disc shaped plate. It can instead be a spoked wheel-like construction. Whatever the form, it preferably has a continuous or discontinuous flange 24 around its periphery which provides a place of attachment for a shell 25 which extends parallel to a central axis 26 of the device from its lower end 27 to its upper end 28.

Shell 25 is preferably approximately a half cylinder, and may be made of a rigid material to form a structural member. An example would be sheet aluminum, or very stiff leather. Optionally or additionally, a plurality of axially-extending ribs 29 (four being shown) can be attached to the base and extend axially from the lower to the upper end of the carrier. They may be attached such as by cement or fasteners to the shell and provide structural reinforcement for it. Alternatively, they may comprise the basic structure, in which case an arcuate end member 30 will be attached to them and to the shell to provide a framework to which the shell is attached. Then the shell may be of flexible or weaker material such as canvas.

Whatever the construction, there will be at the upper end a structure to provide means to support an upper bracket 31 for a purpose yet to be described, which will be structurally supported relative to the base.

Figure 2:
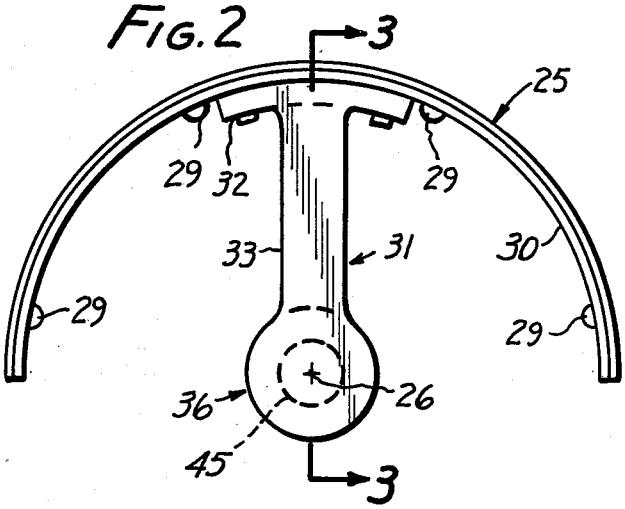
FIG. 2 is a partial top view taken at line 2—2 in FIG. 1.

If desired, additional reinforcement means may extend from the ribs to the bracket, thereby to support it at the axis. However, if the bracket and the remainder of the support are sufficiently rigid, then no more structure than shown in FIG. 2 is required at the upper end, and this makes a simple device.

Bracket 31 includes a base flange 32 attached to the shell, or to the arcuate end member if one is provided. It includes an arm 33 which extends toward the center and intercepts the central axis. The base, the ribs or arcuate end member, or both, and the end bracket comprise the "support". The support also includes a first bearing means 35 at the lower end and a second bearing means 36 at the upper end.

It is the function of the support rotationally to support a golf club holder 40 for rotation around axis 26. Axis 26 is the axis of rotation of the holder, as well as the central axis for the entire device. This holder may include a central shaft 41 adapted to be journaled by the bearing means. The first bearing means preferably includes an axially projecting shaft 42 with a pointed end 43 which extends into a socket 44 in the lower end of the shaft. This relationship can be reversed, and the bearing shaft may be formed as part of the central shaft and the socket formed in the base if preferred. The upper second bearing means 36 comprises a socket 45 in the bracket into which the upper end 46 of shaft 41 is rotatably held. Both bearing means are "thrust bearings" in that they restrain the shaft and club holder from excessive axial movement.

The holder includes a structural frame (FIG. 4). The frame includes at its upper end four stay members 50 which are angularly spaced-apart from one another and attached to a ring 51 which extends peripherally around the central axis. These are fastened together such as by resistance welding. At the lower end (FIG. 8), there are several stay members 52 mounted to a similar ring 53. This forms a cage-like structure to which a peripheral wall member 54 can be attached.

Peripheral wall member 54 has fifteen axially-extending grooves 55 in its outer periphery. These grooves may be rolled or pressed into the material, and extend from end to end of the golf club holder.

A portion 61 of retention means 60 (FIG. 5) is provided along the length of each groove. This portion is punched outwardly, as best shown in FIG. 5, to form a socket 62 which receives and confines the club shaft 63 near its handle end 64. The golf club head 65 is held by another portion 66 (FIG. 10) of the retention means at the upper end of the golf club holder. Portion 66 of the retainer means in its preferred embodiment is a head "holding means", comprising a pivoted loop 67. Such a loop is provided at the upper end of each groove. Each loop has a first portion, shown in solid line in FIG. 1, where it stands axially beyond the shaft and holds the club shaft in the groove. It has a second position shown in solid line in FIG. 10 wherein it is raised up and out of the way of the club head so that the club head can be moved radially and pulled upwardly out of the club holder. The loop remains standing up as a visible reminder that the club has been removed. The loops can conveniently be painted red or some other highly visible color. Also, the various grooves and loops can be painted various different colors respective to specific clubs to form a color-coded arrangement. The pivoted loops are attached to the upper ring 51 by being bent to form turns 68 which enable the loop to be rotated.

As best shown in FIG. 8, brake means 70 is interposed between the support and the golf club holder. A pivoted arm 71 with a bias spring 72 in compression bears a wheel 73. The bias spring forces the free, wheeled, end of the arm toward and against the golf club holder. It will seek to enter the grooves yieldably to restrain the golf club holder in respective positions. A sufficient torque on the gold club holder will overcome the bias spring, cam the wheel out of the groove and permit it to roll until the next groove are reached. The side and top of the support is sufficiently open that each golf club can be removed in some respective rotational position of the golf club holder.

The retention means may instead of the loop or in addition thereto have a plurality of clips 75 as best shown in FIG. 7. Each clip includes a trough 76 to receive the edge of the head. The better to hold the head in the trough, magnetic means 77 which are attractive to an iron or steel golf club head are placed in each clip. Their magnetic retentive forces can be overcome by pulling the club off of it with a sufficient force.

Angle 78 illustrates that each clip can be made respective to a specific respective club. This aids in inventorying the clubs, because then each club will fit in only one respective slot. FIG. 9 shows a group of clips 79, 80, 81, 82 with different angularities for different clubs. This assists the golf player to keep track of his clubs.

FIG. 12 shows another embodiment of bearing means 85 for the lower end of the carrier. Bearing means 35 and bearing means 85 are both thrust bearings in the sense that they permit rotation while supporting the golf club holder relative to the base. Base 86 is a plate having a face 87 with a peripheral ball groove 88 therein. Another face 89 is formed on the lower end of the golf club holder with a respective peripheral groove 90. A plurality of balls 91 which act as a bearing is placed in the peripheral grooves between the plates.

In order to provide for storage of accessory equipment, the golf club holder has three pockets 92, 93, 94 (FIG. 6) each with a respective access slit 95, 96, 97 which may be zippered. These are disposed axially along one wall of the golf club holder and are accessible through an open part of the support when aligned therewith.

FIG. 11 shows that a handle 100 and/or a strap 101 can be attached to the shell. The carrier can be carried by either of these.

The use and advantages of this device should be evident from the foregoing. It provides support means to support the system structurally and to permit the golf club holder to rotate so that the golf clubs can be put into and taken out of the carrier.

This device protects clubs from rattling against each other, assists in inventorying the clubs, and provides a reminder if a club is missing. It is at the same time simple in construction and advantageous in use.

This invention is not to be limited by the embodiments shown in the drawings and described in the description which are given by way of example and not of limitation, but only in accordance with the scope of the appended claims.

I claim:

1. A golf club carrier comprising:

a support; and a club holder having an axis of rotation, said club holder being axially elongated and mounted to said support for rotation around a central axis, said club holder including a plurality of retention means to receive and hold a golf club handle which retention means are laterally spaced from said axis whereby to move circularly around said axis when the club holder is rotated, said support being so constructed and arranged as to give access to a club held by each retention means in at least one respective position to which the club holder can be turned, each said retention means comprising a socket member into which the handle of a club can be placed, and head holding means to hold the head to the club holder, said club holder including a peripheral wall having an axial groove to receive a club handle, a portion of said wall being formed outwardly of the remainder of the groove to form said socket.

2. A golf club carrier according to claim 1 in which said head holding means comprises a pivoted loop which is pivotable to a first position embracing a respective club to hold it, and which is pivotable to a second position wherein the head end of the club is released from the loop.

3. A golf club carrier according to claim 2 in which the head holding means in said second position is visible as a reminder that the club is not in its respective groove.

4. A golf club carrier comprising:

a support; and a club holder having an axis of rotation, said club holder being axially elongated and mounted to said support for rotation around a central axis, said club holder including a plurality of retention means to receive and hold a golf club handle which retention means are laterally spaced from said axis whereby to move circularly around said axis when the club holder is rotated, said support being so constructed and arranged as to give access to a club held by each retention means in at least one respective position to which the club holder can be turned, each said retention means comprising a socket member into which the handle of a club can be placed, and head holding means to hold the head to the club holder, said head holding means comprising a clip.

5. A golf club carrier comprising:

a support; and a club holder having an axis of rotation, said club holder being axially elongated and mounted to said support for rotation around a central axis, said club holder including a plurality of retention means to receive and hold a golf club handle which retention means are laterally spaced from said axis whereby to move circularly around said axis when the club holder is rotated, said support being so constructed and arranged so as to give access to a club held by each retention means in at least one respective position to which the club holder can be turned, each said retention means comprising a socket member into which the handle of a club can be placed, and head holding means to hold the head to the club holder, said head holding means comprising magnetic means attractive to a golf club head for holding said golf club head thereto.

6. A golf club carrier comprising:

a support;

a club holder having an axis of rotation, said club holder being axially elongated and mounted to said support for rotation around a central axis, said club holder including a plurality of retention means to receive and hold a golf club handle which retention means are laterally spaced from said axis whereby to move circularly around said axis when the club holder is rotated, said support being so constructed and arranged as to give access to a club held by each retention means in at least one respective position to which the club holder can be turned; and brake means interposed between the support and the club holder to restrain rotation of the club holder.

7. A golf club carrier comprising:

a support including a pair of bearing means; and a club holder having an axis of rotation, said club holder being axially elongated and mounted to said support for rotation around a central axis, said bearing means rotatably journaling the club holder to the support, said club holder including a plurality of retention means to receive and hold a golf club handle which retention means are laterally spaced from said axis whereby to move circularly around said axis when the club holder is rotated, said support being so constructed and arranged as to give access to a club held by each retention means in at least one respective position to which the club holder can be turned, each said retention means comprising a socket member into which the handle of a club can be placed, and head holding means to hold the head to the club holder, said club holder including a peripheral wall having an axial groove to receive a club handle, a portion of said wall being formed outwardly of the remainder of the groove to form said socket.

8. A golf club carrier according to claim 7 in which said head holding means comprises a pivoted loop which is pivotable to a first position embracing a respective club to hold it, and which is pivotable to a second position wherein the head end of the club is released from the loop.

9. A golf club carrier according to claim 8 in which the head holding means in said second position is visible as a remainder that the club is not in its respective groove.

10. A golf club carrier according to claim 7 in which a portion of the support overhangs the club holder at its upper end and supports one of said bearing means.

11. A golf club carrier according to claim 10 in which said support comprises a partial shell extending axially adjacent to the club holder and having an open side to give access to the club holder.

12. A golf club carrier according to claim 11 in which brake means is interposed between the support and the club holder to restrain rotation of the club holder.

* * * * *